US005210890A

United States Patent [19]

Hagglund

[11] Patent Number: 5,210,890

[45] Date of Patent: May 18, 1993

[54] MATTRESS FOUNDATION WITH SPRINGS AND FOAM ELEMENTS

[75] Inventor: John E. Hagglund, Newberg, Oreg.

[73] Assignee: Tualatin Sleep Products, Tualatin, Oreg.

[21] Appl. No.: 949,034

[22] Filed: Sep. 21, 1992

[51] Int. Cl.[5] ..... A47C 27/20; A47C 23/30

[52] U.S. Cl. ..... 5/239; 5/261; 5/474; 5/475; 5/481

[58] Field of Search ..... 5/239, 241, 243, 260, 5/261, 474, 475, 476, 481

[56] References Cited

U.S. PATENT DOCUMENTS 3,618,146 11/1971 Ferdinand ..... 5/474
3,822,426 7/1974 Mistarz ..... 5/474
4,067,076 1/1978 Krier ..... 5/474

FOREIGN PATENT DOCUMENTS 696349 8/1953 United Kingdom ..... 5/475

*Primary Examiner*—Alexander Grosz
*Attorney, Agent, or Firm*—Klarquist, Sparkman, Campbell, Leigh & Whinston

[57] ABSTRACT

A mattress foundation includes upper and lower frame sections which are resiliently interconnected and supported by a combination of springs and foam. In different embodiments, the springs comprise coil springs, torsion springs, torsion spring modules or a combination thereof. In one embodiment, the foam comprises an elongate piece of foam which extends peripherally around the foundation and envelops or encases the springs. The foam is slitted in a pattern to receive portions of the springs. Alternatively, the foam comprises discrete foam blocks spaced around the periphery of the foundation and between select pairs of adjacent springs.

11 Claims, 5 Drawing Sheets

MATTRESS FOUNDATION WITH SPRINGS AND FOAM ELEMENTS

BACKGROUND OF THE INVENTION

The present invention relates to mattress foundations, and particularly to box spring mattress foundations. Mattress foundations are commonly used in combination with mattresses to complement a mattress' resiliency and/or raise a mattress to a comfortable height from a floor. The support characteristics of mattress foundations are an important factor in the performance and marketability of such foundations.

Rigid mattress foundations, while providing a comfortable sleeping position when combined with a proper mattress, have significant drawbacks. One such example is the rigid mattress foundation disclosed in U.S. Pat. No. 4,535,494 of Diamonstein. To some consumers, the simple lack of resilient support means implies uncomfortable sleep characteristics. This belief may stem from a consumer's perception while sitting on the edge of a mattress/rigid foundation combination, wherein the concentrated body load and lack of foundation deflection may overload the mattress resilient support. Such overloading of the mattress results in an undesirable "bottoming out" effect, whereby the cushioning capacity of the mattress is diminished.

Conventional box springs represent an improvement over rigid mattress foundations. One such box spring uses an array of springs, disposed between a rigid wood lower frame structure and a wire grid upper frame structure, to provide resilient support which complements the deflection of a mattress. While the propensity to overload a mattress is hereby diminished, this box spring design also has drawbacks. For instance, the presence of a great number of metal springs results in a box spring which is relatively heavy and expensive to manufacture. Also, the array of metal springs may be undesirably noisy when weight is shifted on the overlying mattress. In addition, the upper wire grid can be bent if any spring is overly stressed, producing a sagging upper frame structure or uneven support surface to support the mattress.

The prior art has attempted to solve these weight, expense, and comfort problems, but never with completely satisfactory results. For example, U.S. Pat. No. 4,100,631 of Slone attempts to defeat the weight and expense problems by using rigid upper and lower mattress foundation frames of wood, separated by resilient springs. While the Slone box spring does require fewer springs than a comparable conventional box spring, it is subject to inadequate performance under some conditions. Even though the rigid upper frame serves to distribute a centrally-located load well, such as that occurring when a user reclines, the Slone box spring does not react as well to a peripherally-located load. Under a peripheral loading, such as that occurring when a user sits on the edge of the box spring, the Slone upper rigid frame may be unable to adequately distribute a heavy load, thereby overtaxing the springs supporting that portion of the periphery where the load is applied.

While the prior art also attempts to defeat the expense and weight problems through means of resilient foam blocks in place of the springs, this method too has drawbacks. For instance, U.S. Pat. No. 4,191,991 of Morgan places foam blocks around the periphery of a mattress foundation. While these resilient foam supports greatly reduce box spring weight, the gaps between the foam blocks will create weak, unsupported "dead" spots along the periphery of the foundation. Moreover, foam supports characteristically do not exhibit a suitably long service life in most instances. Specifically, the foam supports may tend to lose some resilience and become permanently compressed after a period of use. Such functional degradation is undesirable in a mattress foundation. Similarly, the Slone patent suggests the use of foam rubber as a resilient support for a mattress foundation.

Yet another disadvantage of prior mattress foundations arises from the usual construction at the periphery of the box spring. As explained above, foundations utilizing springs to support the periphery may appear too springy or soft when a user sits thereupon. Furthermore, conventional box springs typically place only a thin cloth apron around the vertical peripheral surfaces of the foundation, resulting in the sagging and loose wrinkling of the apron when the periphery of the mattress foundation is depressed. Moreover, the thin fabric apron on conventional box springs gives users the impression that the interior of the foundation is hollow and nonsubstantial. This impression undermines the perceived quality of a mattress foundation.

Other mattress foundations are disclosed in U.S. Pat. No. 4,662,015 to Galumbeck and U.S. Pat. No. 2,992,443 to Winikoff.

In light of these disadvantages in the prior art, one objective of the present invention is to provide a long-lasting mattress foundation having relatively few springs, a relatively low weight, and a reduced manufacturing cost.

Another object of this invention is to provide a mattress foundation which better distributes loads across the width and length of the foundation, and provides a firmer suspension at the periphery of the foundation.

Yet another object of this invention is to provide a mattress foundation with a smooth, continuous, substantial vertical surface around the skirt of the foundation which will resist sagging and loose wrinkling when the foundation is loaded at the periphery.

Still another object of this invention is to provide a mattress foundation which affords quiet resilient support for an overlying mattress and its occupants.

An additional object of this invention is to provide finer manufacturing control over the suspension characteristics of a mattress foundation than is possible with conventional box springs.

Other objects will be apparent from the detailed description of the present invention.

SUMMARY OF THE INVENTION

This invention responds to the problems presented in the prior art by providing a mattress foundation with a combination of resilient foam and spring support members disposed between relatively rigid bottom and top support frames.

The mattress foundation includes a lower substantially rigid wooden frame assembly with an upper surface suitable for direct mounting of the resilient foam and springs. The foundation also comprises an upper substantially rigid mattress supporting frame which has a lower face suitable for direct mounting to the foam and springs.

The resilient foam and spring support members may be combined in a variety of ways, many of which provide desirable mattress support characteristics. In one embodiment, coil and torsion springs are disposed between the peripheral members of the upper and lower frame assemblies and are attached directly thereto with staples. A single elongate piece of resilient foam with a length approximating the distance around the perimeter of the mattress foundation is then inserted into the space between the upper and lower frame assemblies, peripheral members. In being inserted into position, the foam receives and envelops the individual coil and torsion springs through means of appropriately shaped slits in the interior-facing wall of the foam piece. When installed, the outer wall of the foam piece is substantially flush with the peripheral edges of the mattress assembly.

The assembled rigid frame sections and resilient foam and spring components incorporated therein are concealed by a foundation cover. The cover is comprised firstly of a top section covering the upper frame assembly and whatever other build up is located thereupon; typically, this build-up may include a mattress-supporting corrugated cardboard and an insulator pad. The second cover portion is an apron covering the vertical sides around the periphery of the mattress foundation. In the preferred embodiment, the cover apron is glued uniformly to the vertical peripheral walls of the foam blocks or single foam piece. This cover is typically secured to the foundation by stapling around the periphery of the lower surface of the lower frame assembly. Finally, the bottom of the lower frame assembly is covered by a dust cloth which is stapled flat across the bottom surface of the lower frame assembly.

In an alternate embodiment, a plurality of individual spaced apart foam blocks with appropriate slits are placed in between the springs in the space between the upper and lower frame assemblies.

In yet another preferred embodiment, torsion spring modules are substituted for the torsion springs of the first embodiment and the slit pattern of the elongate foam modified to complement the coil springs and spring modules.

DETAILED DESCRIPTION OF A PREFERRED AND ALTERNATE EMBODIMENTS

Figure 1:
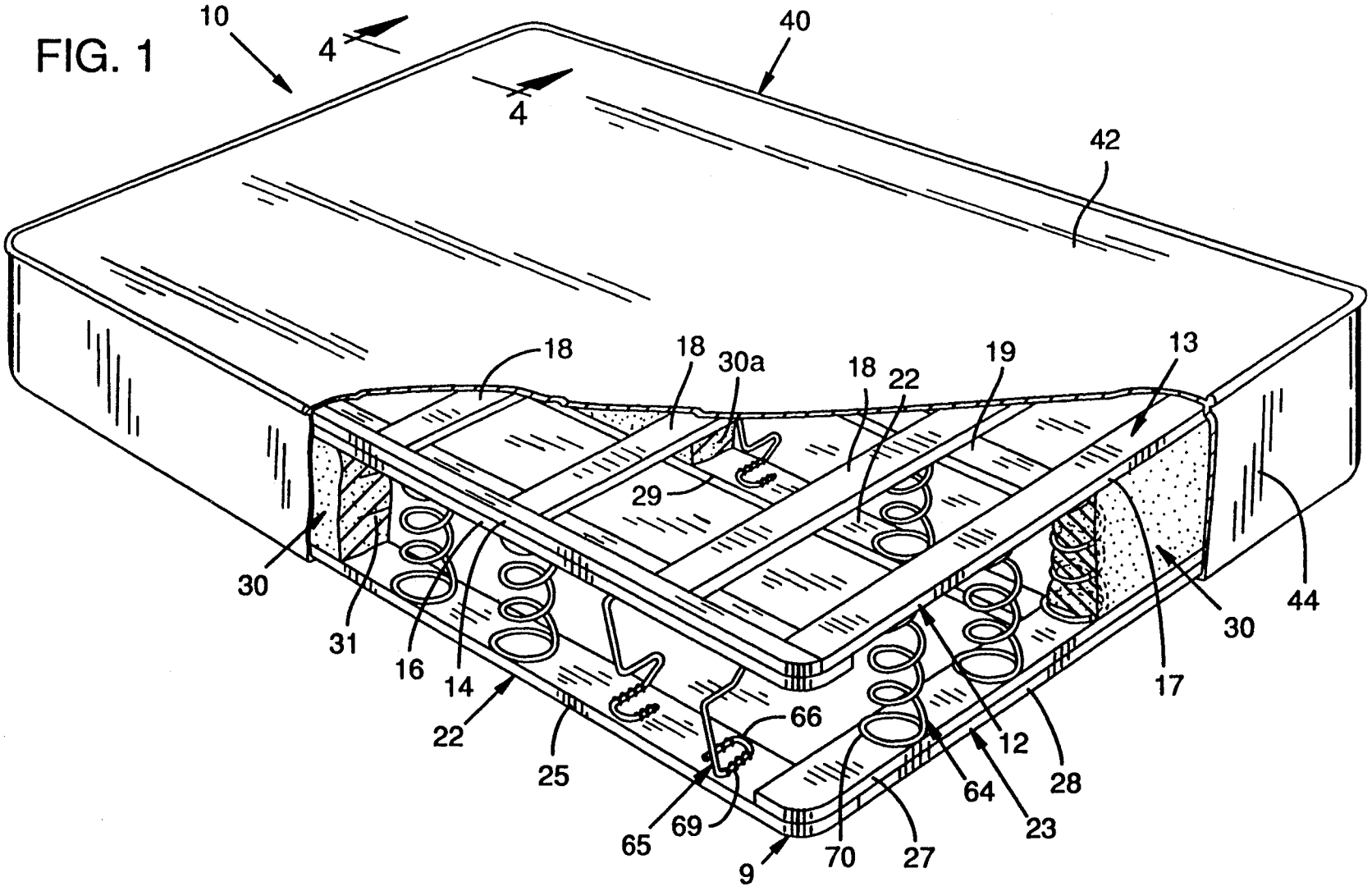
FIG. 1 is a cut away perspective view of a mattress foundation in accordance with the present invention, showing the mattress foundation with part of the cover and part, of the foam structure cut away to show other aspects of the foundation.

The principals of this invention are particularly useful when embodied in a mattress foundation such as that depicted in FIG. 1 and generally identified with the numeral 10. Mattress foundation 10 includes a relatively rigid lower frame section 9 and a relatively rigid upper frame section 13, which preferably are constructed primarily of wood. Positioned in between these upper and lower frame sections is a resilient suspension system, comprised of a spring suspension subsystem and a foam suspension subsystem. The foregoing combined structure is covered and concealed by a fabric mattress foundation cover 40.

The upper frame section 13 includes a pair of parallel, opposed side rails interconnected by a pair of opposed transverse end rails to form a generally rectangular upper frame construction. The side rails are each preferably constructed of two elongate wood frame members 14, 16 which are glued or otherwise secured to one another, with the end rails each being constructed of a single wood frame member 17. The overlying frame member 14 of each side rail has a lesser width than member 16 to provide a ledge to support a plurality of transverse cross frame members 18. The upper frame side and end rail pairs are glued together as shown with their outwardly-directed edges aligned, so as to create upper frame vertical side and end peripheral surfaces. In addition, an upper frame center rail 19 runs lengthwise along the center of the upper frame section and is glued or otherwise secured to the underside of transverse cross frame members 18 and both upper frame end rails 17.

The lower frame section 9 similarly includes a pair of parallel, opposed side rails 22 interconnected by a pair of parallel, opposed end rails 23 to form a generally rectangular lower frame construction. These lower frame side and end rails are rigidly assembled in a manner similar to the upper frame section. The lower frame side rails are preferably constructed of a single elongate wood frame member 25, with the lower frame end rails being constructed of a pair of wood frame members 27, 28 which are glued together. The lower frame side and end rails are arranged with their outwardly-directed edges aligned to create lower frame vertical side and end peripheral surfaces. In addition, a lower frame center rail 29 runs lengthwise along the center of the lower frame section and is glued or otherwise secured to each lower frame end rail 23.

Figure 2:
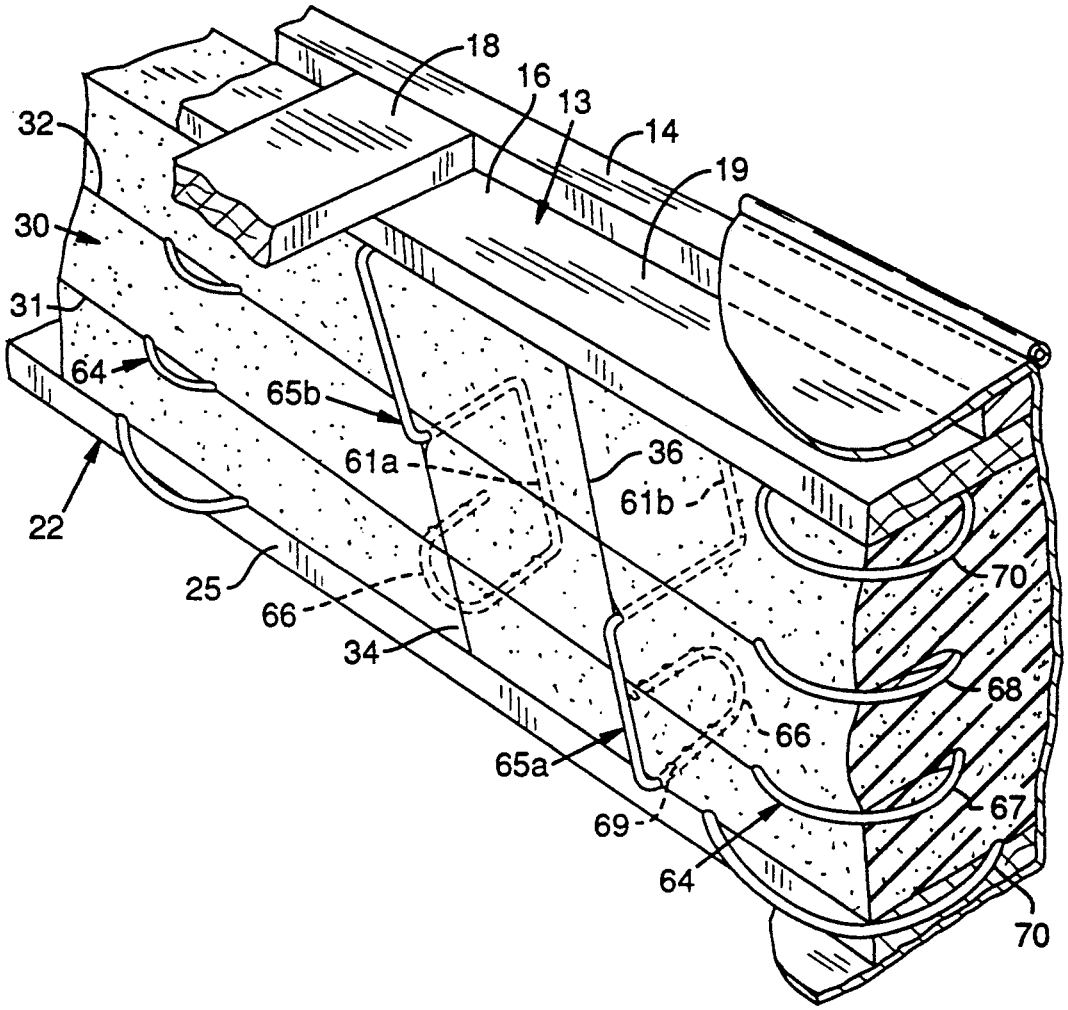
FIG. 2 is an enlarged fragmentary perspective view of an internal periphery portion of the mattress foundation of FIG. 1.
Figure 3:
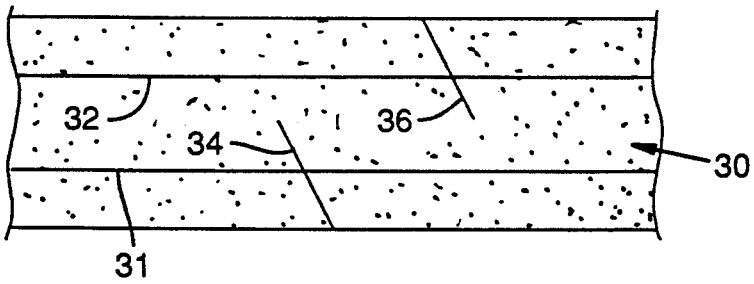
FIG. 3 is a fragmentary side elevation view of the foam structure showing spring receiving slits, with all other structures omitted.
Figure 4:
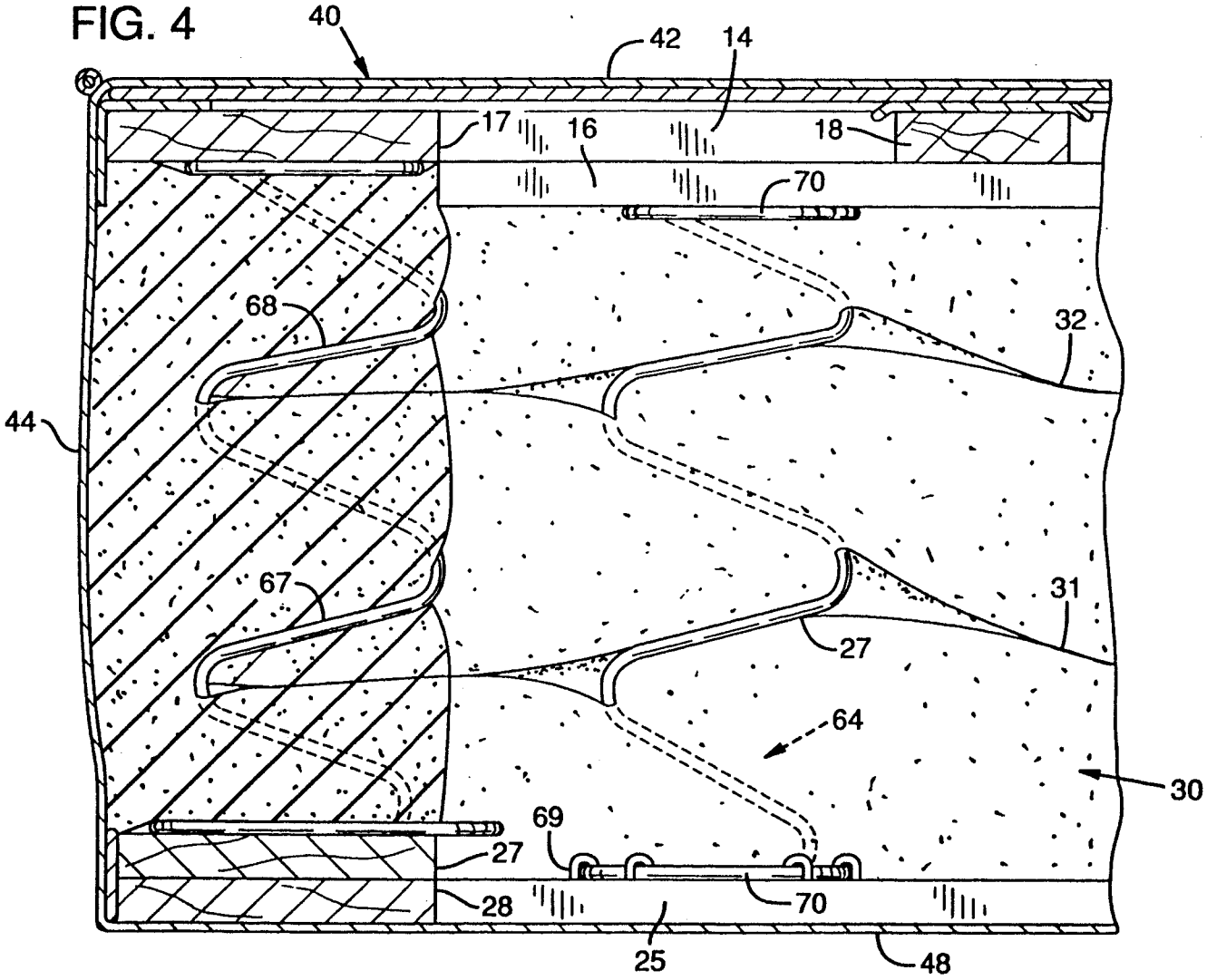
FIG. 4 is an enlarged fragmentary vertical sectional view taken along line 4—4 of FIG. 1, showing the interface of the springs in the foam structure, and the placement of the fabric foundation cover.

The suspension system, comprised of resilient foam and springs, is disposed vertically between the upper and lower frame sections to cooperatively interconnect the upper and lower frame sections in a spaced apart, resiliently supportive manner. FIGS. 2, 3, and 4 illustrate in detail this interconnection, with FIG. 2 being a cut-away illustration depicting the cooperation of the foam suspension subsystem 30 with the plurality of coil springs 64 and torsion springs 65 in resiliently supporting the upper frame. The torsion springs 65 generally are shaped as inverted U's, with upper and lower portions of the springs serving as anchor portions 66. The coil springs 64 of the resilient suspension system typically have two helical interior coils between the respective end coils, the end coils serving as anchor portions 70 (FIGS. 2, 4). The torsion and coil springs used in the present invention have a conventional off-the-shelf construction.

In the construction of FIGS. 1–4, two torsion springs are stapled between and directly to the bottom surface of the upper side rails and upper surface of the lower side rails at locations proximate to each corner of the mattress foundation frame. The stapling is accomplished by driving heavy staples 69 over each torsion spring's anchor portions, at closely-spaced intervals, into the wood of the appropriate side rail. Several coil springs 64 are interspersed between the pairs of torsion springs, and similarly stapled to the upper and lower side rails using anchor portions 70. A plurality of torsion and coil springs are similarly anchored by stapling between center rails 19, 29 to provide a resilient support system therebetween, except that two torsion springs are mounted one-third and two-thirds, respectively, along the length of the center rails with one or more coil springs located therebetween. A plurality of coil springs are similarly anchored by stapling between the upper frame and lower frame end rails to complete the spring suspension subsystem interconnecting the upper and lower frame sections.

It will be appreciated that the number and arrangement of torsion and coil springs can be varied from the particular embodiment shown. Similarly, many of the advantages of the present invention can be obtained by using a variety of different types of springs and, for example, it is not critical that coil or torsion springs be used.

The foam suspension subsystem 30 comprises a continuous elongate piece of foam which is wrapped around the periphery of the mattress foundation, filling the space between the upper and lower side rails and between the upper and lower end rails. The foam has an outer wall surface which cooperates with corresponding outer surfaces of the side and end rails to define substantially continuous vertical side and end walls extending substantially along the entire periphery of the mattress foundation. The foam subsystem 30 is inserted into place once the coil and torsion springs are securely interconnecting the upper and lower frames.

As FIG. 3 depicts, the foam subsystem 30 is provided with parallel longitudinal slits 31, 32 and diagonal slits 34, 36 contained therein to enable the foam structure to receive and substantially envelop the coil and torsion springs. The foam structure is inserted under a slight compression between the upper and lower frame structures. Longitudinal slits 31, 32 extend about about two-thirds to three quarters of the thickness dimension of the foam, as shown in FIG. 2, to allow the foam to fill the interstices between the spring coils. These longitudinal slits are cut just deep enough to snugly engage the outermost portions of the spring coils such that these outermost portions serve as a stop which determines how far the foam may be inserted or wedged inwardly toward the center of the mattress foundation. The depth of the longitudinal slits is such that, when inserted, the foam's outer wall is vertically aligned with the upper and lower side/end rails between which the foam is sandwiched.

As shown in FIGS. 2 and 4, the coil springs have two interior coils 67, 68 which are received and snugly enveloped by the foam structure. To this end, the longitudinal slits 31, 32 are vertically positioned to coincide with the "height" or "level" of the two interior coils at their outermost portions. As illustrated in FIG. 4, the longitndinal slits 31, 32 deflect significantly to receive and encase substantially all to the two interior coils.

Turning to the envelopment of the torsion springs by the foam structure, diagonal slits 34, 36 in FIG. 3 represent a pair of the slits necessary to accept and encase the torsion springs as, for example, springs 65*a*, 65*b* (FIG. 2). As with the coil spring slits, the diagonal torsion spring slits are cut just deep enough to snugly envelop the outermost portion of the torsion spring, such as torsion spring vertical sections 61*a*, 61*b* (FIG. 2). In addition, the horizontal and anchor portions are substantially enveloped by the foam. The diagonal slits are placed along the length of the foam structure, corresponding with the location of torsion springs along the periphery of the mattress foundation. Likewise, the orientation of the diagonal slits will differ according to the type of torsion springs utilized in the mattress foundation.

A further aspect of the foam subsystem installation is the flush alignment of the foam subsystem outer wall between the peripheral vertical surfaces of the upper and lower frame sections. In other words, the outermost surface of the foam structure is vertically aligned and flush with the outermost vertical surfaces of the side and end rails to provide a pair of flat side walls and end walls for the mattress foundation core.

The foam suspension subsystem 30 also includes an elongate strip of foam 30*a* (FIG. 1) which extends the full length of the mattress foundation between upper and lower center rails 19, 29. Center strip 30*a* has longitudinal and diagonal slits as described above to permit the center strip to enclose and envelop the springs supporting the upper and lower center rails. For clarity's sake, FIG. 1 does not show the entire center strip.

Referring to FIGS. 1 and 4, the fabric mattress foundation cover 40 is constructed of a top portion 42 which covers the upper frame structure in overlying relationship, and a skirt section 44, which covers the foundation side and end walls. The top portion 42 is pulled tightly over the cross frame members 18 of the upper frame structure by pulling the skirt tightly down over the foundation side and end walls. A layer of adhesive is spread evenly along the entirety of the foam structure outer wall or, alternatively, over the entirety of the foundation side and end walls (including the foam outer walls). Once the foundation cover skirt is pulled snugly over this adhesive area, the cover is secured in place by a series of staples inserted through a relatively narrow band of the cover skirt which extends below the foundation side and end walls. This band of cloth is pulled over the lower frame section side and end rails and is attached thereto by a series of staples.

Though not shown, an insulative pad can be provided between the upper frame structure supportive members and the mattress foundation cover. As shown in FIG. 4, a dust cloth 48 is stapled to the periphery of the bottom face of the lower frame structure to cover the opening in the lower frame structure which otherwise would exist.

Figure 7:
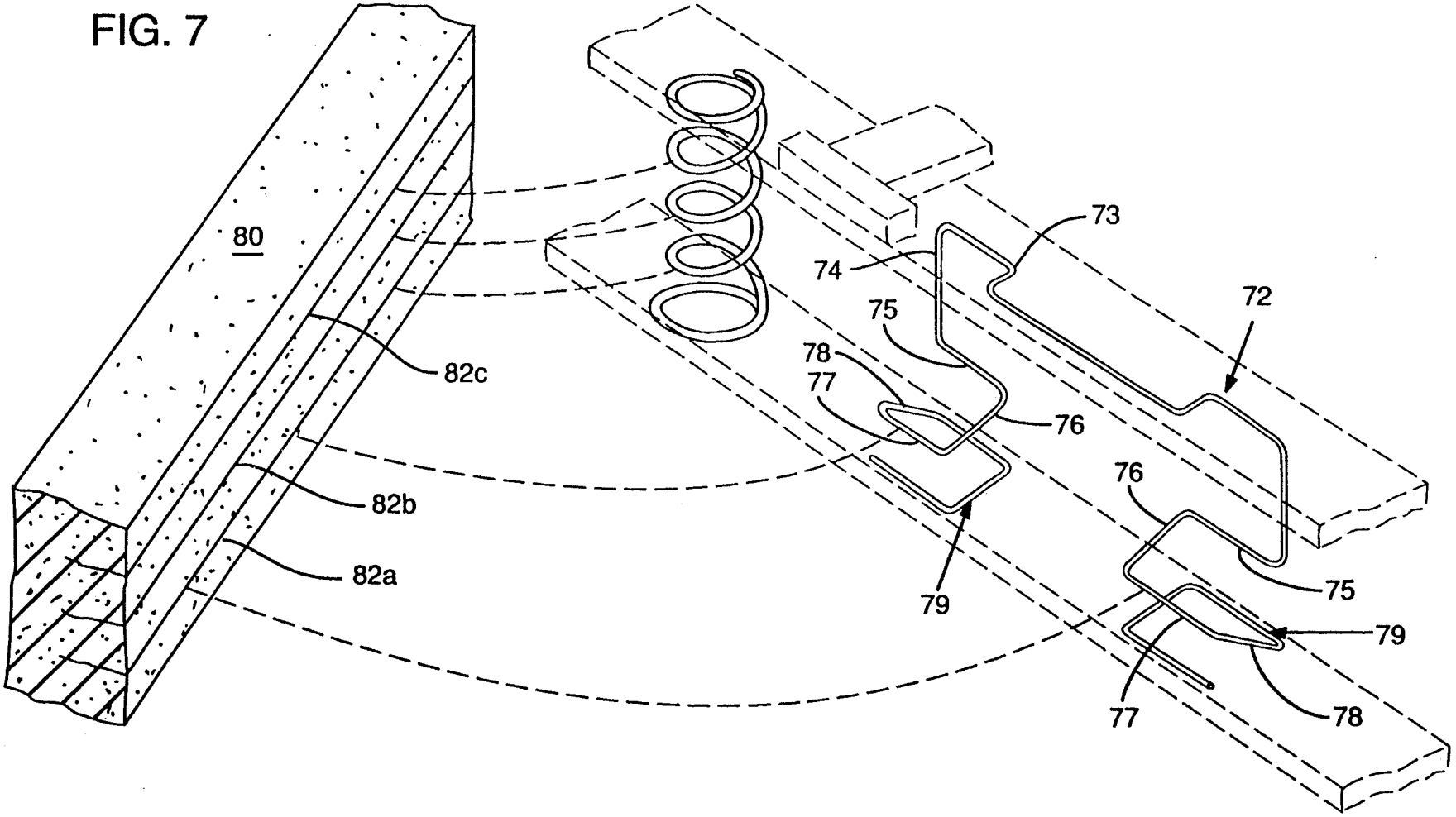
FIG. 7 is an enlarged fragmentary exploded perspective view of a periphery portion of a third preferred embodiment of the present invention.

A preferred embodiment of the present invention shown in FIG. 7 is identical to the embodiment just described, except that a spring torsion module 72 is substituted for each torsion spring. Each torsion module 72 has an upper, generally U-shaped anchor portion 73 which lies in a horizontal plane; a pair of spaced apart vertical legs 74 which extend downwardly from anchor portion 73 to join respective inwardly extending horizontal portions 75; a pair of spaced apart downwardly and outwardly extending legs 76; a pair of spaced apart horizontal portions 77 joined to respective legs 76; a pair of downwardly and inwardly directed legs 78 joined to respective portions 77; and a pair of horizontal U-shaped anchor portions 79 joined to legs 78 to provide a flat anchor for stapling to the lower frame section. The spring modules cooperate with adjacent coil springs, as before, to provide a resilient support system which is enveloped in a foam support member 80. Foam member 80 is identical to the elongate foam member described above, except that the diagonal slits have been omitted as unnecessary and three equally spaced horizontal slits 82*a,b,c* have been provided to receive coil springs having three interior coils. The lowermost slit 82*a* receives the lowermost interior coil of the coil springs as well as the central portion of the spring module which protrudes outwardly. Slit 82*a* is aligned at the same vertical level as the horizontal portions 77 of each torsion spring module.

The invention thus provides for a mattress foundation which is inexpensive and lightweight due to the relatively few springs that are necessary to provide a high quality and long-lasting resilient support system. The invention's cooperative arrangement of foam and spring resilient support offers superior support characteristics. The interaction of foam with the springs attenuates the bounciness of the springs, thereby delivering a steady, but pliant, resilient support. In addition, the foam provides additional continuous resilient support along virtually the entire periphery of the foundation, including support in the gaps between the springs, and along the center back bone of the foundation as well. The character of this support can be finely tuned by varying the density of the resilient foam. For instance, firmer support is obtained through the use of high-density foam, while more springiness is achieved by using lower-density foam. Accordingly, the ease in varying the invention's resilient support characteristics enables the low-cost and efficient production of mattress foundations with a wide selection of firmnesses.

The envelopment of the springs by the resilient foam produces other advantages. The snug envelopment of the torsion and coil springs within the foam yields very little spring noise, producing very quiet mattress foundation operation when the load located thereon is shifted. The combination of the springs and foam along the periphery of the mattress foundation also results in a perception of substantial support when the foundation is peripherally loaded, due to the large section of foam peripherally situated to absorb and support peripheral loads. Additionally, when peripherally loaded, the uniform adhesion of the foundation cover skirt to the outer wall of the foam piece prevents sagging or loose folding of the mattress foundation skirt, providing a desirable smooth, integral appearance of the mattress foundation as a whole.

As another advantage, the foam's uniform and full supportive backing of the cover skirt makes the skirt more resistant to tearing and the attendant exposure of the springs.

The capacity of the invention's skirt area to resist tearing and exposure of the springs merits further attention. Specifically, the encasement of the springs offers a safety advantage in that the foam envelopment serves to sheath the sharp edges of a spring fracture surface in the event of spring failure. In the same way, the foam shielding serves to prevent the accidental pinching of hands, etc., which may occur in conventional mattress foundations when the skirt is torn. Such a pinching risk arises when skirt tearing exposes the closely underlying springs of a conventional mattress foundation, which are situated within easy reach of an unsuspecting occupant of the overlying mattress.

Figures 5, 6:
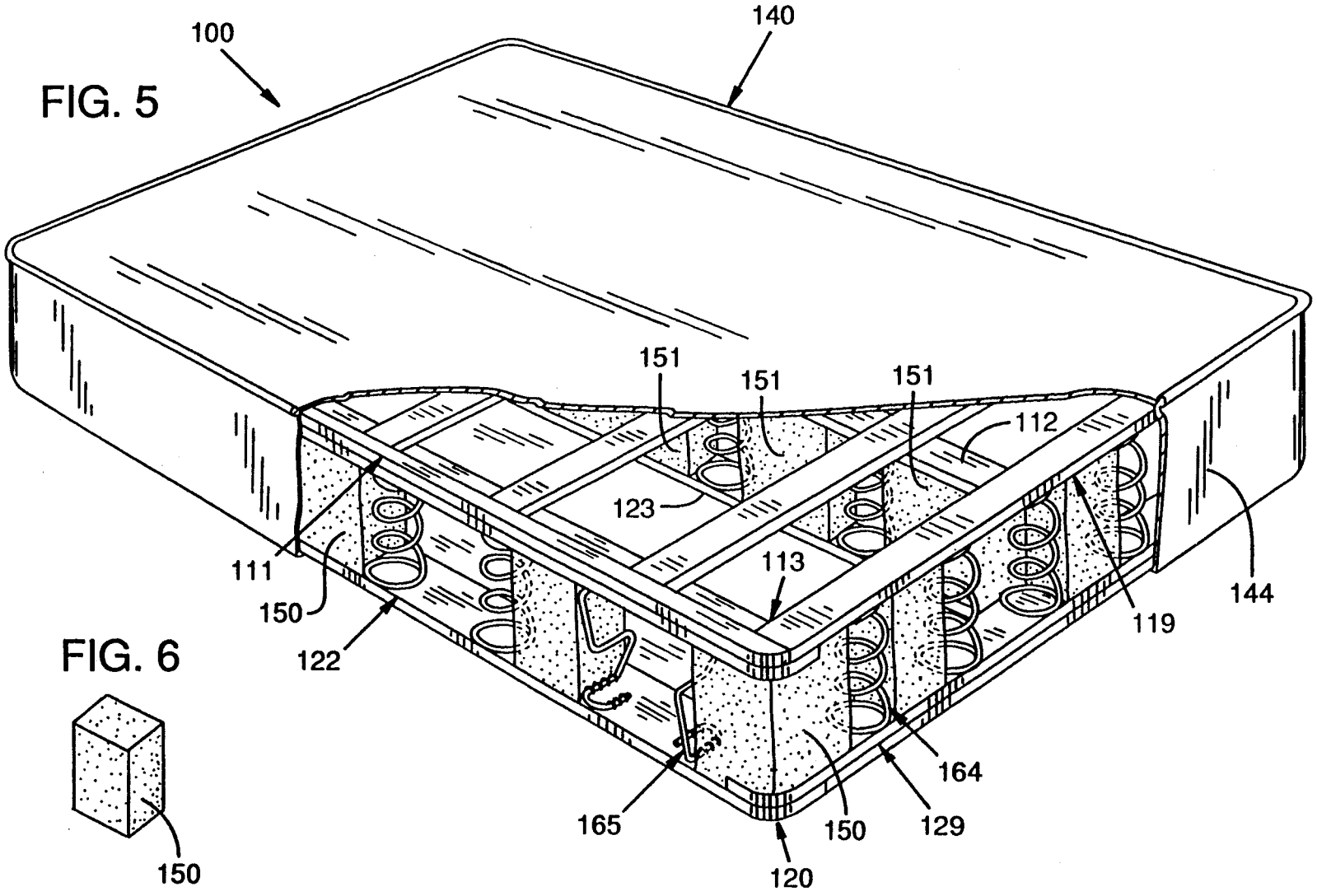
FIG. 5 is a cut away perspective view of a mattress foundation in accordance with a second embodiment of the present invention.
FIG. 6 is a perspective view of one of the foam blocks shown in FIG. 5.

An alternate embodiment of the present invention is depicted in FIGS. 5 and 6. Except as noted below, the mattress foundation 100 so depicted has a foundation frame or core which is identical to the one described above and includes an upper frame section 113, lower frame section 120, a plurality of coil springs 164 and torsion springs 165 resiliently interconnecting the upper and lower frame sections, and a fabric foundation cover 140 to encase the core. However, in place of the elongate, slitted piece of foam which is wrapped around the periphery of the foundation core to encase the springs, the alternate embodiment includes a plurality of foam blocks 150 spaced between selected springs around the periphery of the foundation core and central foam blocks 151 spaced between selected springs along the longitudinal center. These blocks are fitted under a slight compression into the space vertically between the upper frame section (including side, center and end rails 111, 112, 119) and the lower frame section (including side, center and end rails 122, 123, 129). The blocks also are interspersed snugly horizontally between coil springs 164 torsion springs 165 interconnecting the frame structures.

It will be appreciated that the foam blocks may have varying dimensions appropriate for a snug fitting between springs of varying types and spacing. Because of the interspersion between the springs, these foam blocks require no slits to achieve effective positioning and operation. As in the earlier embodiment, the alignment of the outer walls of blocks 150 with the vertical peripheral surfaces of the upper and lower frame sections is flush. In so being, these peripheral blocks are suitable as adhesive surfaces for the uniform attachment to the skirt 144 of the foundation cover 140.

It will be appreciated that the frame members of the upper and lower frame sections are substantially rigid so as to provide a support surface for an overlying mattress or the like. The frame members desirably have some flexibility but should be sufficiently rigid to support the types of loads typically applied to mattress foundations and, preferably, to spread a localized load over a wider surface area of the frame sections (as when a user sits on the edge of the mattress). As with many conventional mattress foundations, wood frame members work well to provide some flexibility in the frame but sufficient strength and rigidity to withstand the normal wear, tear and loading to which mattress foundations are typically subject.

Of course, it should be understood that other modifications of the preferred embodiments described herein will be apparent to those skilled in the art. Such changes and modifications can be made without departing from the spirit and scope of the present invention and without diminishing its attendant advantages. It is, therefore, intended that such changes and modifications will be covered by the following claims.

What is claimed is:

1. A mattress foundation having an outer periphery assembly comprising:

a substantially rigid lower frame assembly having lower peripheral members;

a substantially rigid upper frame assembly having upper peripheral members, said upper peripheral members overlying said lower frame peripheral members, said upper frame assembly having a plurality of cross-support members situated between the said upper peripheral members;

a resilient foam structure in supporting contact with said upper and lower peripheral members to provide resilient support for said upper peripheral members;

a plurality of springs in supporting contact with said upper and lower peripheral members to provide resilient support for said upper peripheral members;

the foam structure including an elongate piece of foam which extends substantially around said outer periphery to supportively engage the upper and lower peripheral members for substantially their entire length;

the springs having a predetermined configuration and spaced relationship relative to the upper and lower peripheral members, and said foam structure having slits complementary to said configuration and relationship to permit the foam structure to substantially envelop the springs; and the springs including plural coil springs and plural torsion springs.

2. A mattress foundation according to claim 1, wherein said foam structure includes a plurality of discrete foam blocks spaced along the periphery of the foundation.

3. A mattress foundation according to claim 2, wherein a fabric cover having top and skirt portions attaches over said upper and lower frame assemblies, said skirt portion being attached with adhesive to said foam structure.

4. A mattress foundation assembly having an outer periphery comprising:

a lower frame assembly having lower peripheral members;

an upper frame assembly having upper peripheral members, said upper peripheral members overlying said lower peripheral members, said upper frame assembly having a plurality of cross-support members extending between at least two of said upper peripheral members;

an elongate piece of foam extending substantially around said outer periphery said supportively contacting said upper and lower peripheral members to resiliently support said upper peripheral members, the foam having a flat outer surface with a portion of the upper and lower peripheral members flush with a portion of said upper and lower peripheral members; and a fabric cover having a skirt portion adhesively affixed to said outer surface to inhibit wrinkling of said skirt portion when said upper frame assembly is depressed toward said lower frame assembly;

a plurality of springs interconnecting said upper and lower peripheral members and encased by said foam; and said springs include plural coil and torsion springs.

5. A mattress foundation according to claim 4, wherein said foam has longitudinal slits configured and located to snugly receive and encase the coil springs and diagonal slits oriented to snugly receive and encase said torsion springs.

6. A mattress foundation assembly comprising:

a wooden upper frame assembly having a pair of opposed upper side rails and a pair of opposed upper end rails interconnecting said upper side rails;

a wooden lower frame assembly having a pair of opposed lower side rails and a pair of opposed lower end rails interconnecting said lower side rails;

spring support means attached to said upper and lower frame assemblies to resiliently interconnect said upper side and end rails to said lower side and end rails; and foam support means is supporting engagement with said upper side and end rails and lower side and end rails, said foam support means substantially encasing a plurality of spring support means to provide resilient support for said upper frame assembly;

said foam support means including an elongate piece of foam having an outer wall surface which cooperates with said end and side rails to define a substantially continuous vertical side wall which extends along substantially the entire periphery of said mattress foundation; and a fabric cover having side panel portions which are adhesively affixed substantially uniterruptedly to said outer wall surface.

7. A mattress foundation according to claim 6, wherein said spring support means includes plural coil and torsion springs.

8. A mattress foundation according to claim 7, wherein said foam support means includes slit means adapted to receive and snugly encase said coil springs and torsion springs.

9. A mattress foundation according to claim 8, wherein said foam support means is attached directly to the upper and lower frame assemblies.

10. A mattress foundation according to claim 7, wherein said foam support means includes a plurality of discrete spaced apart foam blocks, each of which is affixed to said upper and lower frame assemblies and located between two or said springs.

11. A mattress foundation comprising:

a substantially rigid wooden upper frame assembly including peripheral adjoining upper frame members and an upper central frame member;

a substantially rigid wooden lower frame assembly in underlying spaced apart relationship to said upper frame assembly and including peripheral adjoining lower frame members and a lower central frame member;

a plurality of springs in alignment with and supportively contacting said upper and lower peripheral frame members and said upper and lower central frame members; and a resilient foam structure in alignment with and supportively contacting said upper and lower peripheral frame members and said upper and lower central frame members, said foam structure cooperating with said springs to provide a resilient yet supportive interconnection between said upper and lower frame assemblies;

the spring being comprised of at least two different types of springs;

the foam structure being slit in such a manner as to receive in enveloping relationship the different types of springs.

* * * * *